US007399114B2

(12) United States Patent
Hiranuma et al.

(10) Patent No.: US 7,399,114 B2
(45) Date of Patent: Jul. 15, 2008

(54) TIMEPIECE HAVING GLASS AND EDGE MEMBER REMOVABLE AS A UNIT

(75) Inventors: Haruki Hiranuma, Chiba (JP); Kinshuro Itoh, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/635,469

(22) Filed: Dec. 7, 2006

(65) Prior Publication Data

US 2007/0147185 A1 Jun. 28, 2007

(30) Foreign Application Priority Data

Dec. 26, 2005 (JP) ..... 2005-372822

(51) Int. Cl.
*G04B 39/00* (2006.01)

(52) U.S. Cl. ..... 368/294; 368/309

(58) Field of Classification Search ..... 368/294–296, 368/291, 286, 309–310; 968/368, 373
See application file for complete search history.

(56) References Cited

U.S. PATENT DOCUMENTS 3,979,902 A * 9/1976 Miyasaka et al. ..... 368/394
4,496,248 A * 1/1985 Waki et al. ..... 368/291

* cited by examiner

*Primary Examiner*—Renee S Luebke
(74) *Attorney, Agent, or Firm*—Adams & Wilks

(57) ABSTRACT

A timepiece has a glass fixed to an annular edge member to permit the glass and edge member to be removed as a unit from a case band. A tubular part of the edge member is removably inserted in a hole in the case band. An annular engaging groove in the case band communicates with an annular attaching groove in the tubular part through plural through-holes in the edge member tubular part. A C-shaped spring member is fitted in the attaching groove in a compressed state and has plural convex parts that extend through respective through-holes into the engaging groove to releasably secure the edge member to the case band.

4 Claims, 5 Drawing Sheets

TIMEPIECE HAVING GLASS AND EDGE MEMBER REMOVABLE AS A UNIT

BACKGROUND OF THE INVENTION

1. Field of the Invention

The present invention relates to a timepiece such as a portable watch, such as a wristwatch and a pocket watch, a desk clock and a wall-mounted clock.

2. Description of the Prior Art

Heretofore among wristwatches having a case back, there is known a wristwatch in which an annular protrusion part is formed in an inner periphery of a front side end part of a case band in which a dial is accommodated, and to the inner periphery of this annular protrusion part there are fitted and fixed a glass covering the dial and fitted a tubular part of an edge member functioning also as a bezel. A caulking part integral with the tubular part is caulked to a back face of the annular protrusion (for example, refer to JP-UM-B-5-37273 Gazette).

In the wristwatch in which the edge member has been caulked to the case band as mentioned above, since the fact that a caulked part having been deformed is caulked again after having been returned to a state before being caulked extremely decreases a mechanical strength of the caulked part, it is impossible to detach the edge member from the case band. For this reason, in a case where the edge member has been impaired, a user of the wristwatch is obliged to exchange not only the edge member to which the glass has been fixed but also to exchange it together with the case band to which this edge member has been caulked.

Further, in a wristwatch in which a waterproofness is achieved by nipping a seal packing between the case band and the edge member, there is considered the fact that a performance of the seal packing decreases during a long period guarantee term of the wristwatch and thereafter. Also in a case where, in order to cope with this, it is attempted to exchange the seal packing, since it is impossible to detach the edge member from the case band, it is necessary to exchange not only the edge member but also to exchange it together with the case band to which the edge member has been caulked.

SUMMARY OF THE INVENTION

An object of the present invention is to provide a timepiece in which it has been made possible to exchange the edge member to which the glass has been fixed, without also exchanging the case band.

The present invention comprises an annular case band which has a front side end part forming a fitting hole, and in which this end part has an annular engaging groove opening to the fitting hole together with an edge receiving face around the fitting hole, a case back having been detachably attached to a back side end part of the case band, an annular edge member which has a tubular part fitted so as to be capable of being inserted into and disengaged from the fitting hole and a cover part overlapped with the edge receiving face, and in which, in the tubular part, there has been formed an annular attaching groove opening to an inner periphery face of the tubular part, and there have been formed plural through-holes communicating the fitting groove and the engaging groove under a state that the tubular part has been fitted to the fitting hole, a glass having been fitted and fixed to an annular step part having been formed in the edge member, and a C-shaped spring member which is detachably attached to the attaching groove under a state that the case back has been detached, and which has plural catching convex parts caught to the engaging groove through the through-hole.

In the present invention, the front side end part of the case band may protrude into an inner hollow part of the case band, or may not protrude. In the present invention, the edge receiving face may be provided continuously so as to bulge from a front side open end of the fitting hole to its periphery, or may be provided by forming a step between it and the front side open end such that the front side open end and the edge receiving face exist in different height positions about a thickness direction of the case band. Further, the edge receiving face and a contact face, of the cover part, contacting with the former are not limited to a plane along a direction perpendicularly intersecting with a thickness direction of the case band, and may be formed by a slant face along a direction slantingly intersecting with the thickness direction of the case band or a curved face curving along the direction slantingly intersecting with the thickness direction of the case band.

In the present invention, the outer periphery of the tubular part and the fitting hole into which this tubular part is inserted may be a circular shape or a polygonal shape. In the present invention, a fixation of the glass to the annular step part of the edge member may be fixed by using an adhesive, or pressure-inserting the glass to the annular step part with a seal ring having an elasticity being nipped between it and the annular step part. In the present invention, the spring member of the C-shaped form or the like can be suitably used by a metal spring wire material or the like. Together with this, a sectional shape of the spring member may be a circular shape or a quadrangular shape.

In the present invention, a state that the cover part of the edge member has been overlapped with the edge receiving face of the case band by the fact that the tubular part of the edge member to which the glass has been fixed is inserted into the fitting hole of the case band, is held by the C-shaped spring member which is accommodated in the attaching groove of the tubular part having been disposed in the case band, and which has plural catching convex parts caught to the engaging groove of the front side end part of the case band through the through-hole of the tubular part, and this spring member can be attached/detached under a state that the case back has been opened. For this reason, in a case where the edge member has been impaired or the like, the edge member can be attached to and detached from the case band by attaching/detaching the spring member. Accordingly, the edge member to which the glass has been fixed can be exchanged without accompanying the case band.

In a preferred mode of the present invention, there is possessed an annular seal packing having been nipped between the edge receiving face and the cover part under a compressed state. Here, the seal packing may be provided by annularly forming a holding groove in either of the edge receiving face and the cover part and fitting it to this holding groove, or also can be provided without forming such a holding groove.

In this preferred mode, as already mentioned, since an incorporation and a separation of the edge member with respect to the case band can be performed by the attachment/detachment of the spring member, in a case where a performance of the seal packing bearing a waterproofness/dustproofness between the edge receiving face and the cover part has decreased, it is possible to exchange this packing without accompanying at least the case band between the case band and the edge member.

Additionally, in a preferred mode of the present invention, by protruding at least one end part of the spring member to an inside of the tubular part, it is made an operating part when detaching the spring member from the attaching groove.

In this preferred mode, since the operating part becoming a clue for detaching the spring member is previously protruded to the inside of the tubular member under a state that the spring member has been attached to the tubular part, it is possible, when detaching the edge member from the case band, to pull out the spring member from the attaching groove of the tubular part to the inside of the tubular part while deforming the spring member by grasping the operating part while resisting against the elasticity of the spring member.

Further, in a preferred mode of the present invention, the glass is fixed to the annular step part by an adhesive.

In this preferred mode, since the attachment/detachment of the spring member to/from the tubular part of the edge member is performed without giving an excessive strain to the edge member, there is no fear that the glass is exfoliated with the strain of the edge member being made a cause when attaching/detaching the edge member to/from the case band. Moreover, in addition to the fact that a periphery face of the glass is bonded to an annular periphery face of the annular step part along a thickness direction of the edge member, since a periphery part back face of the glass is bonded to a seat face of the annular step part continuous perpendicularly to the annular periphery face, a bonding area can be largely ensured. For this reason, it is possible to thin a thickness of the edge member while ensuring a necessary bonding area with respect to the glass.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

One embodiment of the present invention is explained by referring to FIG. 1-FIG. 6.

Figure 1:
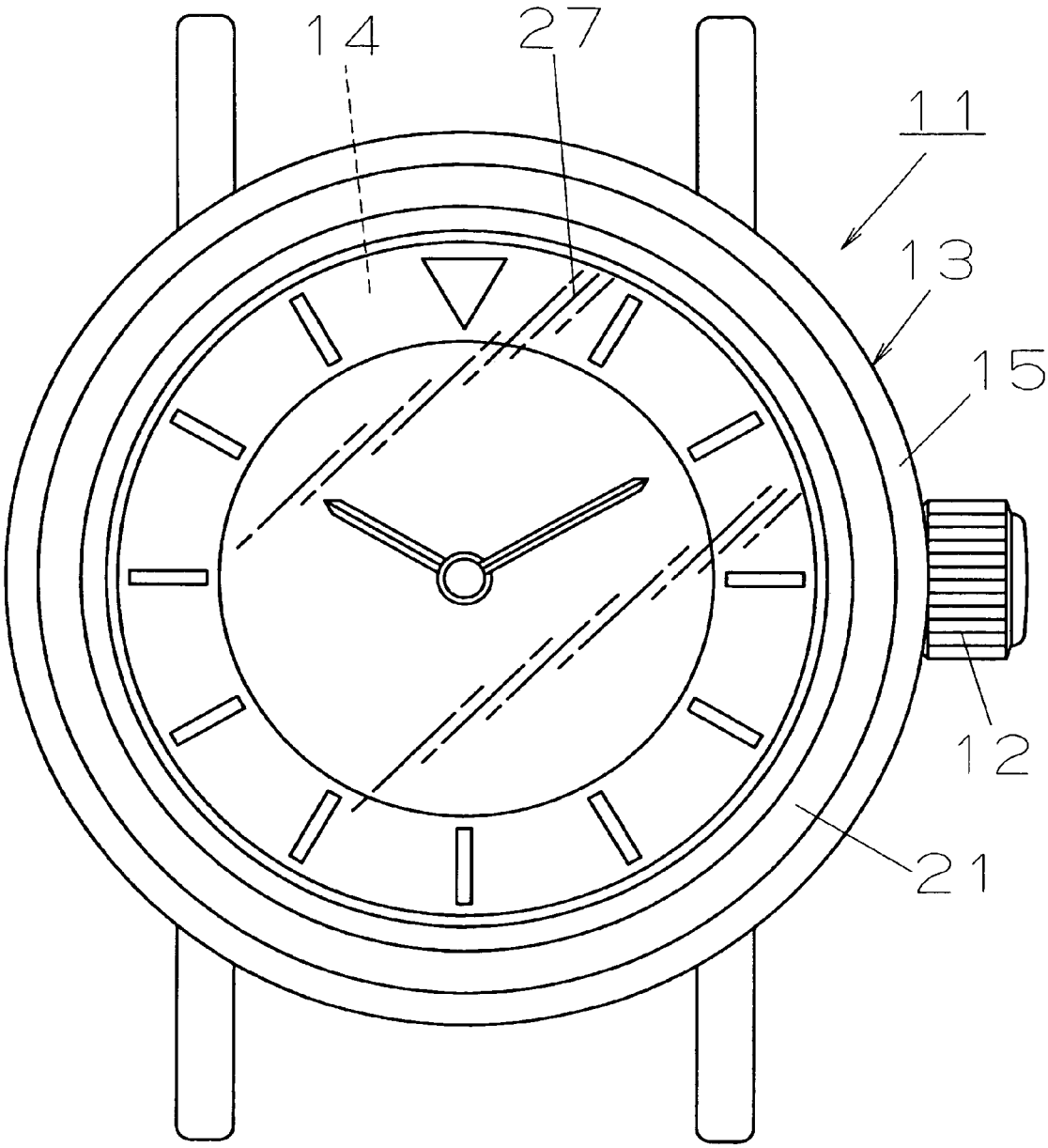
FIG. 1 is a plan view showing a wristwatch concerned with one embodiment of the present invention.
Figure 2:
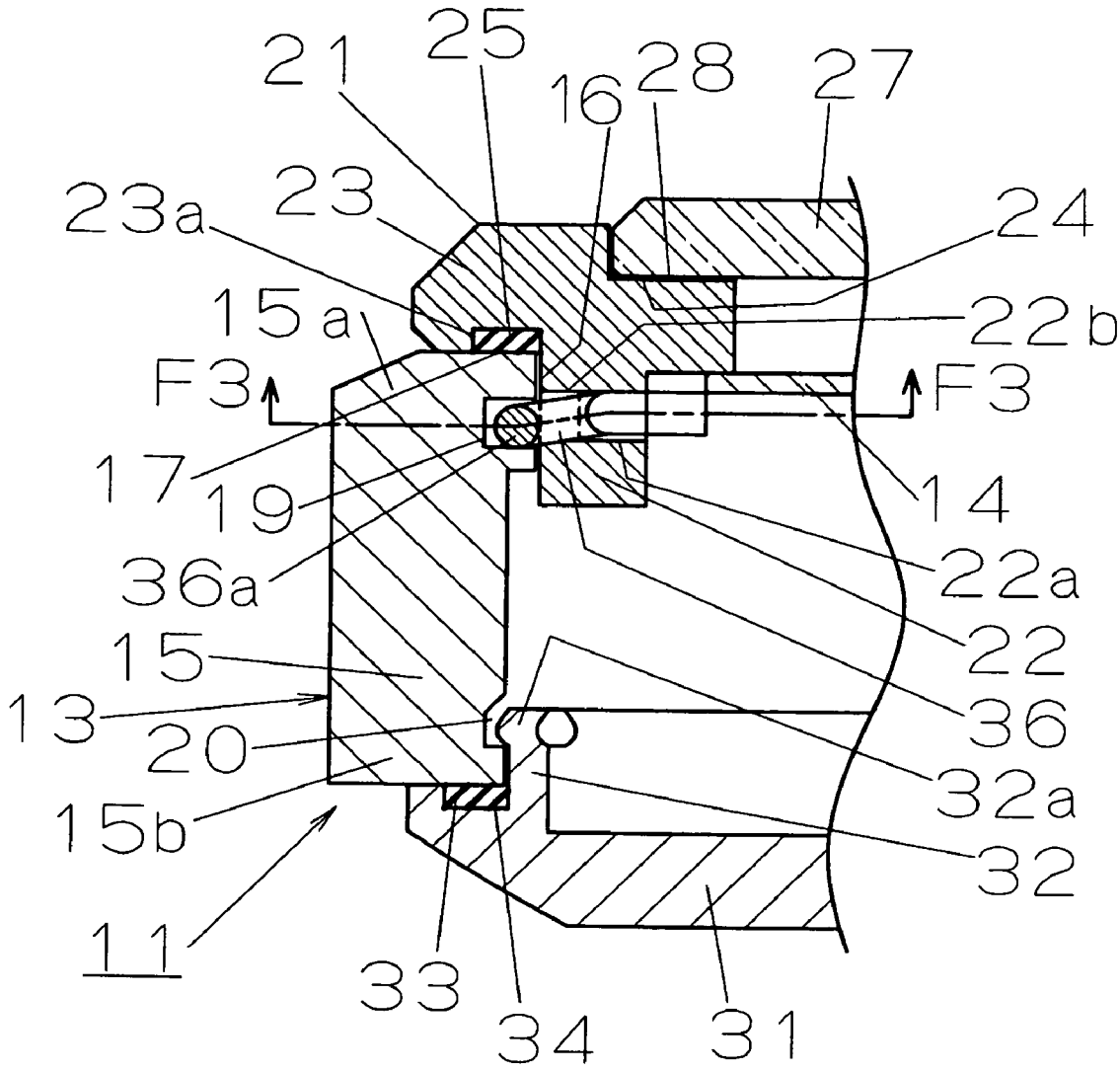
FIG. 2 is a sectional view showing one part of the wristwatch of FIG. 1, while being enlarged.

In FIG. 1, a reference numeral 11 denotes a timepiece, e.g., a portable timepiece having a screw-locked crown 12, namely a wristwatch. As shown in FIG. 2, the wristwatch 11 accommodates, in its timepiece armor assembly 13, a dial 14, a timepiece movement not shown in the drawing, and the like. The timepiece movement may be one having any type of power source, such as a small battery or a mainspring, or an automatically winding one, or a digital timepiece which digital-displays time and the like on the dial 14 by a quartz oscillation module, or a combination analog and digital timepiece, or the like.

As shown in FIG. 2, the timepiece armor assembly 13 is formed by mounting a glass 27 to a front side of an annular case band 15 through an edge member 21, and liquid-tightly mounting a case back 31 consisting of a metal or the like to a back side of the case band 15.

The case band 15 consists of a metal such as stainless steel and titanium or a synthetic resin. The case band 15 has a front side end part 15*a*. This front side end part 15*a* is protruded toward, e.g., an inner hollow part of the case band 15, and a fitting hole 16 is formed in the front side site 15*a* of the case band 15. The fitting hole 16 is circular for instance.

A surface of the front side end part 15*a* forms an edge receiving face 17. This edge receiving face 17 is formed by a plane continuous perpendicularly to the fitting hole 16 so as to extend, e.g., from a front side open end of the fitting hole 16 to its periphery. In the front side end part 15*a*, there is formed an annular engaging groove 19 which opens to an inner periphery face of the front side end part 15*a* (in other words, which opens to the fitting hole 16).

A locking groove 20 is formed in an inner face of a back side end part 15*b* of the case band 15. The case back 31 is detachable with respect to the case band 15 from its back side. For this reason, the case back 31 integrally has an in-case-band insertion tubular part 32 which is elastically deformable, and engaging convex parts 32*a* (only one is shown in the drawing) are formed in several places of a tip part of the in-case-band insertion tubular part 32.

Accordingly, by inserting the in-case-band insertion tubular part 32 into a back face opening of the case band 15, the engaging convex part 32*a* is caught by a locking groove 20 at the same time as this engaging convex part 32*a* slides over a lower side edge of the locking groove 20 while accompanying an elastic deformation of the in-case-band insertion tubular part 32, so that it is possible to mount the case back 31 to the case band 15. Under this attached state, it is possible to detach the case back 31 from the case band 15 by inserting a tip part of a tool, such as a minus driver (not shown in the drawing), into a peripheral part of the case back 31 and the back side end part 15*b* to thereby detach the engaging convex part 32*a* from the locking groove 20 by wrenching the case back 31. Incidentally, in FIG. 2, a reference numeral 33 denotes an annular seal packing made of a resinous elastic material. The seal packing 33 is nipped in a compressed state by the case band 15 and the case back 31 to provide waterproofness/dustproofness between them, and is fitted and attached, e.g., to a holding groove 34 provided in the case back 31.

Figure 5:
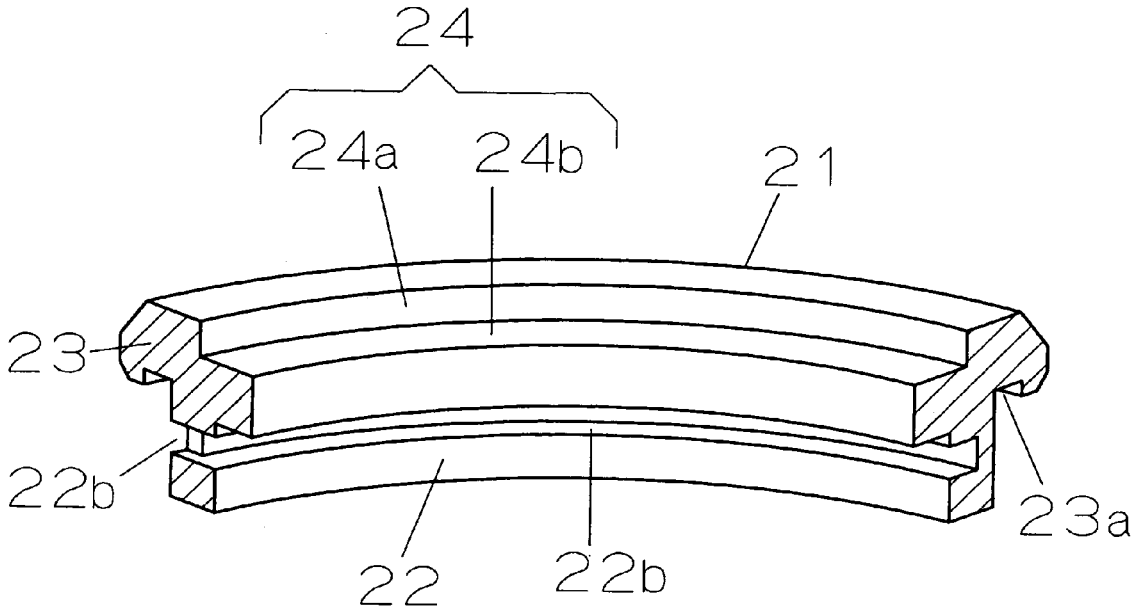
FIG. 5 is a perspective view showing one part of the edge member that the wristwatch of FIG. 1 possesses, while being seen from an inside.

The edge member 21 is one used as, e.g., a glass edge holding the glass 27, and is annularly formed by the metal such as stainless steel and titanium or the synthetic resin. As shown in FIG. 2 and FIG. 5 or the like, the edge member 21 has integrally a tubular part 22, a cover part 23 and an annular step part 24.

Figure 3:
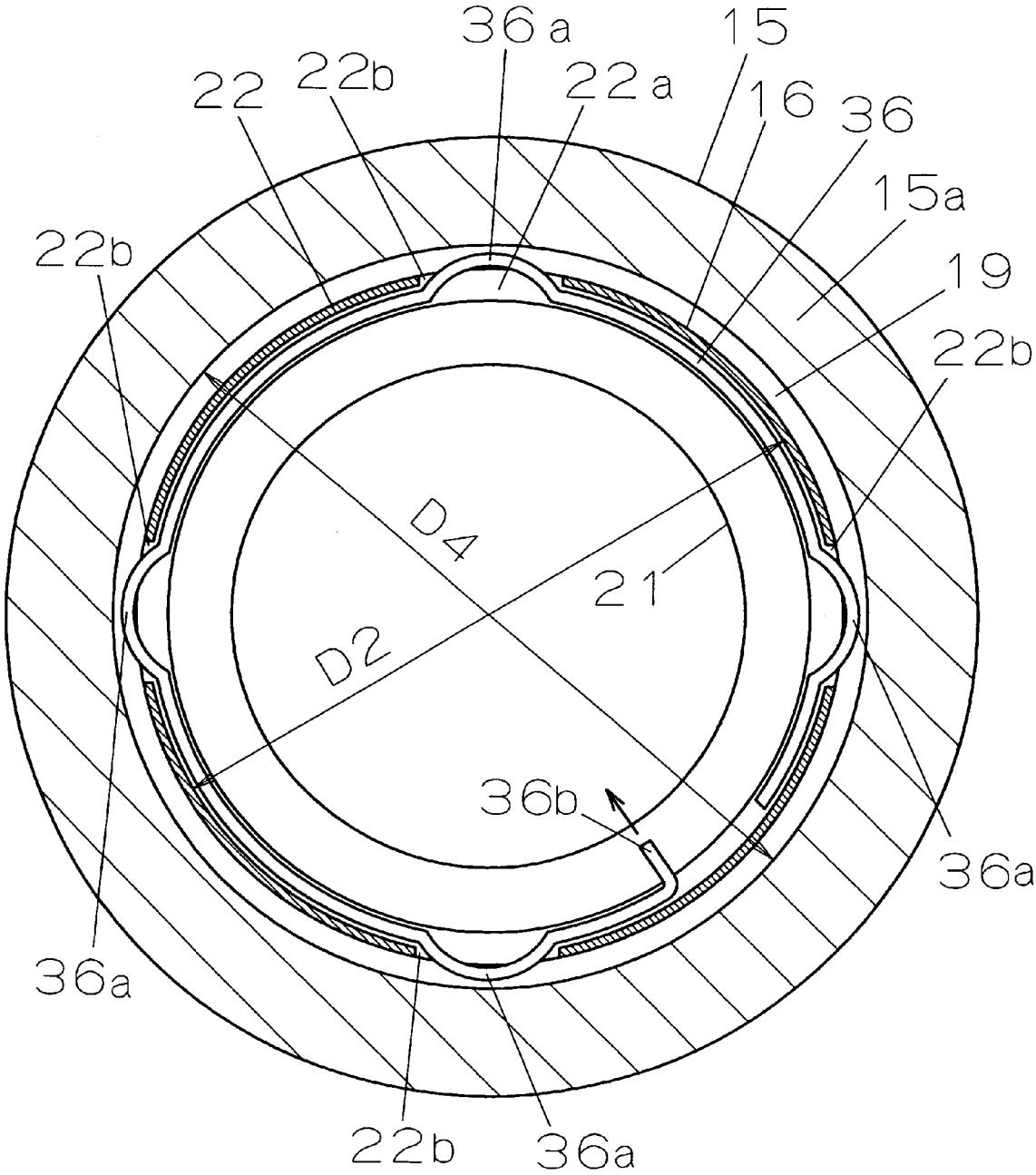
FIG. 3 is a sectional view showing along an arrow line F3-F3 in FIG. 2.
Figure 4:
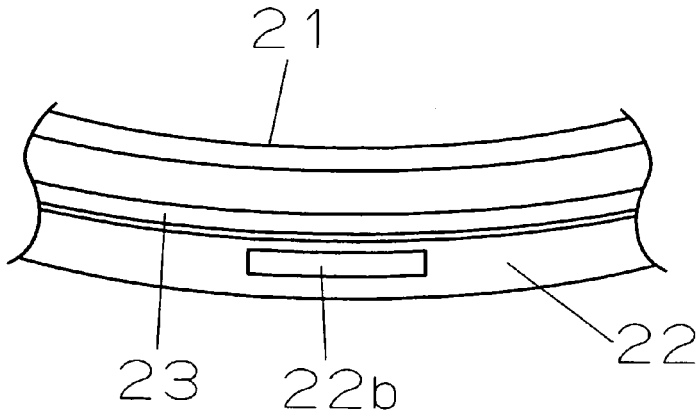
FIG. 4 is a perspective view showing one part of an edge member that the wristwatch of FIG. 1 possesses, while being seen from an outside.

The tubular part 22 is one fitted to the fitting hole 16 so as to be capable of being inserted into and disengaged from the same and, as shown in FIG. 3, forms a cylindrical shape for instance. As shown in FIG. 2, it is desirable that a height of the tubular part 22 is made longer than a thickness of the front side end part 15*a* of the case band 15. As shown in FIG. 2-FIG. 5, in the tubular part 22, there is formed an annular attaching groove 22*a* which opens to an inner periphery face of the former, and there are formed plural through-holes 22*b*. It suffices if the through-holes 22*b* are provided by 3 to 5, and these are provided in the same interval in a peripheral direction of the tubular part 22. These through-holes 22*b* are respectively opened to an outer periphery face of the tubular part 22, and respectively opened also to an interior face of the attaching groove 22*a*. As shown in FIG. 4, each through-hole 22*b* forms a rectangle which is long in the peripheral direction of the tubular part 22. Additionally, an outer periphery of a tip site extending from the attaching groove 22*a* to a tip face of the tubular part 22 becomes a taper face in which this tip site is tapered.

The cover part 23 overlaps the edge receiving face 17 of the front side end part 15*a*. In a back face of this cover part 23, there is formed an annular holding groove 23*a*. In this holding groove 23*a*, there is fitted an annular seal packing 25 (refer to FIG. 2) made of the resinous elastic material. A thickness of the seal packing 25 under its free state is larger than a depth of the holding groove 23*a*.

As shown in FIG. 5, the annular step part 24 provided in an inner periphery side of the edge member 21 has an annular periphery face 24*a* and a seat face 24*b*. The annular periphery face 24*a* is provided along a thickness direction of the edge member 21, and the seat face 24*b* is formed continuously, perpendicularly to the annular periphery face 24*a*. It is desirable that an area of the seat face 24*b* is larger than an area of the annular periphery face 24*a*. The glass 27 is fitted and fixed to this annular step part 24 through an adhesive 28 (refer to FIG. 2).

The fixation of the glass 27 to the edge member 21 is performed by fitting the glass 27 to the annular step part 24 after the adhesive 28 has been applied to a corner part that the annular periphery face 24*a* and the seat face 24*b* form. By this, the adhesive 28 between the annular step part 24 and a periphery part of the glass 27 is extended along the annular periphery face 24*a* and the seat face 24*b*, the periphery face of the glass 27 contacting with the annular periphery face 24*a* is bonded, and a periphery part back face of the glass 27 contacting with the seat face 24*b* is bonded to the edge member 21.

The edge member 21 to which the glass 27 has been mounted like this is detachably attached to the case band 15 by using a spring member 36. The spring member 36 is formed in a C-shaped form by a metal-made spring wire material whose section is circular, and integrally has plural catching convex parts 36*a* and, e.g., one operating part 36*b*.

Figure 6:
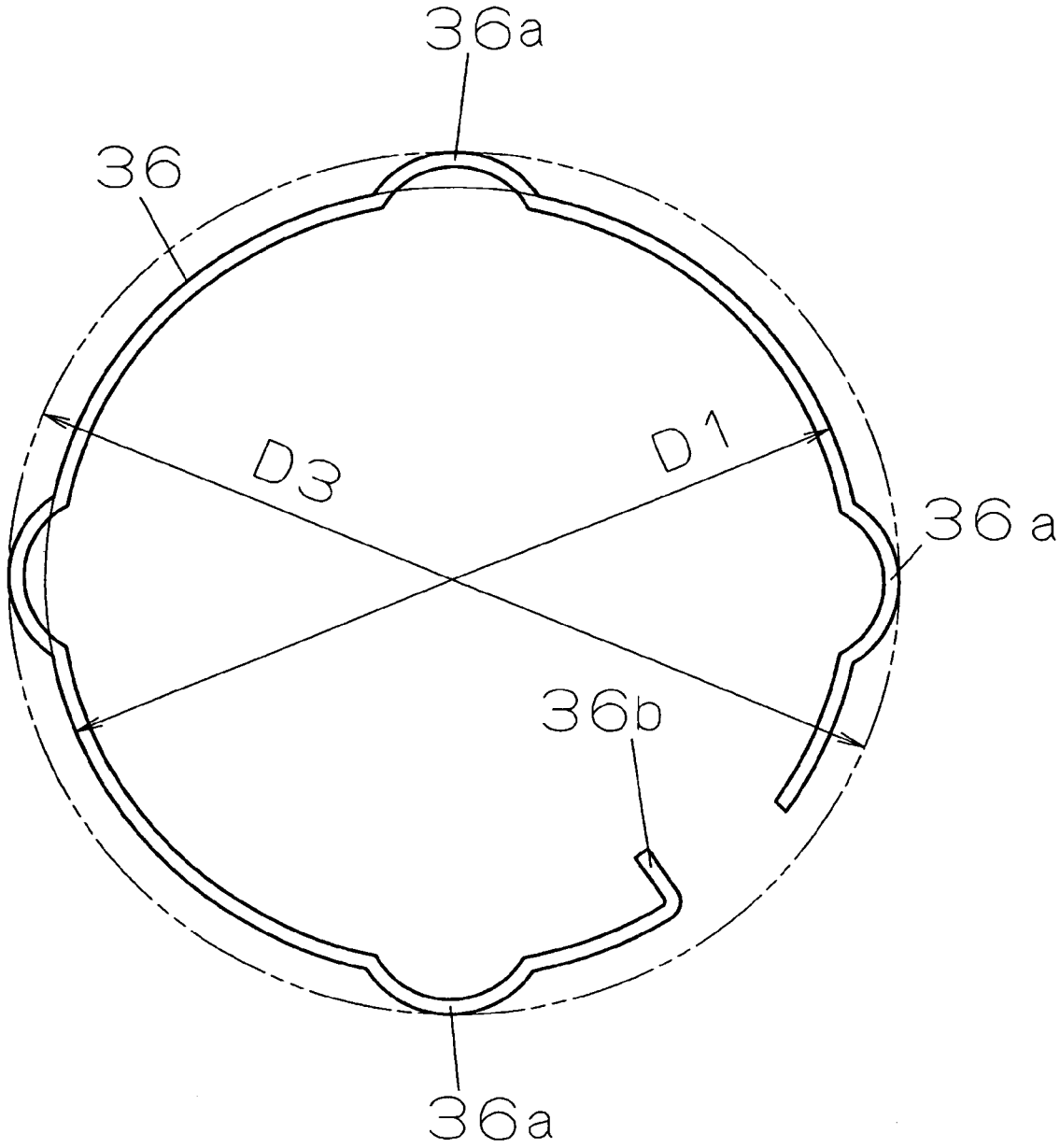
FIG. 6 is a perspective view showing a spring member that the wristwatch of FIG. 1 possesses.

As shown in FIG. 3 and FIG. 6 or the like, the catching convex part 36*a* is curved, e.g., like an arc, and has a size capable of passing through the through-hole 22*b*, and protrudes to an outside of the spring member 36 from a center of the spring member 36 toward a radial direction. The operating part 36*b* is formed by bending one end part of the spring member 36 toward an inside, e.g., the center, of the spring member 36. The operating part 36*b* may be formed also in the other end part of the spring member 36. A diameter (shown by a sign D1 in FIG. 6) of the spring member 36 under its free state is larger than a diameter (shown by a sign D2 in FIG. 3) passing through an interior face of the attaching groove 22*a* and, further, an imaginary diameter (shown by a sign D3 in FIG. 6) of the spring member 36 under its free state, which is depicted while passing an apex of each catching convex part 36*a*, is approximately the same as a diameter (shown by a sign D4 in FIG. 3) passing an interior face of the engaging groove 19.

An attachment/detachment of the edge member 21 to/from the case band 15 is implemented inside the case band 15 as follows under a state that the case back 31 has been detached.

There are explained procedures for attaching the edge member 21, to which the glass 27 and the seal packing 25 have been already incorporated, to the case band 15.

First, the tubular part 22 of the edge member 21 is fitted to the fitting hole 16 of the case band 15 from the front side of the case band 15 and, while compressing the seal packing 25 having been disposed between the edge receiving face 17 of the front side end part 15*a* and the cover part 23 of the edge member 21, a back face of the cover part 23 is butted against the edge receiving face 17.

In this state the through-hole 22*b* of the tubular part 22 communicates with and faces the engaging groove 19 of the case band 15. In this case, although the engaging groove 19 and the through-hole 22*b* may face one another in the same height position, it is desirable, as shown in FIG. 2, to adopt a setting in which the height positions of the attaching groove 22*a* and the through-hole 22*b* deviate to a surface side with respect to the engaging groove 19.

Next, with this state being held intact, the spring member 36 is accommodated in the case band 15 from the back face opening of the case band 15, the spring member 36 is fitted to the attaching groove 22*a* by pushing it to an inner periphery of the tubular part 22 while elastically deforming it so as to reduce its diameter, and is inserted into the engaging groove 19 by passing its catching convex part 36*a* through the through-hole 22*b*. On this occasion, the catching convex part 36*a* is inserted into the through-hole 22*b* by moving the spring member 36 in its peripheral direction.

The insertion of the catching convex part 36*a* into the through-hole 22*b* like this is performed by a behavior in which the spring member 36 in the attaching groove 22*a* is restored in a direction along which its diameter is increased by its elastic force and, also after this insertion, the spring member 36 maintains its elastically deformed state. Incidentally, under this state, the operating part 36*b* of the spring member 36 is protruded to an inside of the tubular part 22 as shown in FIG. 3.

Like the above, since the catching convex part 36*a* having passed through the through-hole 22*b* is caught to the engaging groove 19 of the case band 15, the edge member 21 is mounted to the case band 15 as shown in FIG. 2. By this attachment, the glass 27 is faced on the dial 14.

Additionally, as to the spring member 36 under its free state, the catching convex part 36*a* and a site other than the former exist in the same height positions when seen from a side face direction. On the other hand, as already mentioned, the attaching groove 22*a* and the through-hole 22*b* as well as the engaging groove 19 deviate in the height direction. With these being made a cause, under a state that the edge member 21 has been attached to the case band 15 by using the spring member 36, with the catching convex parts 36*a* having been caught to the engaging groove 19 as shown in FIG. 2 being made supporting points, the spring member 36 is elastically deformed to a state in which a site other than these convex parts is located in an upper side. By this, the edge member 21 is biased in a back side direction of the case band 15 by a force by which the spring member 36 attempts to flatly restore. Accordingly, an attaching state of the edge member 21 to the case band 15 can be more stabilized, and a compressed state of the seal packing 25 is additionally strengthened, so that a liquid tightness between the edge member 21 and the case band 15 can be more ensured.

Next, there are explained procedures for detaching the edge member 21 from the case band 15.

By inserting a tool (not shown in the drawing) from the back face opening of the case band 15 under a state that the case back 31 has been detached and grasping the operating part 36*b* of the spring member 36 by this tool, the operating part 36*b* is moved in a direction shown by an arrow mark in FIG. 3. By this inward movement of the operating part 36*b*, the spring member 36 is elastically deformed so as to decrease its diameter and each catching convex part 36*a* of the spring member 36 is pull-moved to an inside of the tubular part 22, and it is possible to detach the spring member 36 from the attaching groove 22*a* of the tubular part 22 by detaching the catching convex parts 36*a* from the engaging groove 19 of the case band 15. In this manner, since the holding of the edge member 21 with respect to the case band 15 is released, it is possible thereafter to detach the edge member 21 by drawing it out from the case band 15.

According to the detachment procedures of the edge member 21 like this, since it is unnecessary to detach the edge member 21 by wrenching the edge member 21 from the front side of the case band 15, there is no fear that the edge member 21 and the front side end part 15*a* of the case band 15 are injured.

Since it is possible to attach/detach the edge member 21 to/from the case band 15 as mentioned above, in a case where the edge member 21 and the glass 27 have been impaired, it is possible to exchange the edge member 21 and the glass 27, which are exchange objects, by detaching them from the case band 15 by the already mentioned procedures. Similarly, also in a case where a waterproof/dustproof performance of the seal packing 25 has decreased due to a long period use of the wristwatch 11, after the edge member 21, to which the glass 27 has been fixed, has been detached from the case band 15 by the already mentioned procedures, it is possible to exchange the seal packing 25 which is similarly the exchange object without accompanying the edge member 21, to which the glass 27 has been fixed, and the case band 15. Accordingly, in each of these cases, since it becomes unnecessary to discard at least the case band 15 together with an exchange component, an exchange expense for a repair client can be reduced.

The already-mentioned attachment/detachment of the spring member 36 to/from the tubular part 22 of the edge member 21 is performed without giving an excessive strain to the edge member 21. Hence, there is no fear that, when the edge member 21 is attached/detached to/from the case band 15, the strain of the edge member 21 is exerted on a bonding part of the glass 27 and thus the glass 27 is exfoliated. Since an action exfoliating the bonding does not work when attaching/detaching the edge member 21, a thickness of the edge member 21 can be thinned. Accordingly, it is possible to make thinner the whole of the wristwatch 11. And, even if the edge member 21 is thinned, in addition to the fact that the periphery face of the glass 27 is bonded to the annular periphery face 24*a* of the annular step part 24 along its thickness direction, since a periphery part back face of the glass 27 is bonded to the seat face 24*b* of the annular step part 24 and a bonding area of the glass 27 with respect to the edge member 21 can be largely ensured, it is possible to securely fix the glass 27 to the edge member 21.

Incidentally, in a case where the glass 27 is attached to the edge member 21 with an annular elastic packing being nipped between the periphery face of the glass 27 and the annular periphery face 24*a* of the annular step part 24 under its compressed state, the seat face 24*b* of the annular step part 24 cannot be used as a fixing face. For this reason, it is necessary to obtain a necessary glass holding force by increasing a height of the annular periphery face 24*a* and, therefore, it is obliged to thicken the edge member 21 in comparison with the present embodiment.

According to the present invention, it is possible to provide a time piece in which it has been made possible to exchange the edge member without accompanying the case band in a case where edge member, to which the glass has been fixed, has been impaired, or the like.

What is claimed is:

1. A timepiece comprising an annular case band having a front side end part defining a fitting hole, an annular engaging groove formed in the front side end part and opening to the fitting hole, and an edge receiving face extending around the fitting hole;

a case back detachably attached to a back side end part of the case band;

an annular edge member having a tubular part removably inserted into and removable from the fitting hole, a cover part overlapped with the edge receiving face, an annular attaching groove opening to an inner periphery face of the tubular part, and plural through-holes communicating the attaching groove and the engaging groove;

a glass fitted and fixed to an annular step part formed in the edge member; and a C-shaped spring member detachably attached to the attaching groove of the edge member and having plural convex parts extending through respective ones of the through-holes into the engaging groove of the case band.

2. A timepiece according to claim 1, further including an annular seal packing nipped between the edge receiving face and the cover part in a compressed state.

3. A timepiece according to claim 1, wherein at least one end part of the spring member protrudes to an inside of the tubular part and constitutes an operating part when detaching the spring member from the attaching groove.

4. A timepiece according to claim 1, wherein the glass is fixed to the annular step part by an adhesive.

* * * * *